US008538300B2

(12) United States Patent
Watanabe

(10) Patent No.: US 8,538,300 B2
(45) Date of Patent: Sep. 17, 2013

(54) DEVELOPING DEVICE WITH IMPROVED DEVELOPER TRANSPORT EFFICIENCY

(75) Inventor: Wataru Watanabe, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 288 days.

(21) Appl. No.: 13/050,364

(22) Filed: Mar. 17, 2011

(65) Prior Publication Data

US 2011/0229208 A1 Sep. 22, 2011

(30) Foreign Application Priority Data

Mar. 18, 2010 (JP) ..... 2010-062744

(51) Int. Cl.
*G03G 15/08* (2006.01)

(52) U.S. Cl.
USPC ..... 399/254

(58) Field of Classification Search
USPC ..... 399/254
See application file for complete search history.

(56) References Cited

U.S. PATENT DOCUMENTS

| | | | | |
|---|---|---|---|---|
| 7,769,326 | B2 * | 8/2010 | Miyoshi | 399/254 |
| 2006/0165440 | A1 | 7/2006 | Adachi | |
| 2009/0232558 | A1 | 9/2009 | Kudo et al. | |
| 2010/0028053 | A1 | 2/2010 | Kasai | |
| 2010/0322670 | A1 * | 12/2010 | Ishiguro et al. | 399/254 |

FOREIGN PATENT DOCUMENTS

| | | |
|---|---|---|
| CN | 101533247 | 9/2009 |
| JP | 2001-117337 | 4/2001 |
| JP | 2002-278270 | 9/2002 |
| JP | 2006-208577 | 8/2006 |
| JP | 2009-217048 | 9/2009 |
| JP | 2010-49024 | 3/2010 |
| JP | 2010-256838 | 11/2010 |

OTHER PUBLICATIONS

Notification of Reasons for Refusal mailed Jul. 31, 2012, directed to Japanese Application No. 2010-062744; 5 pages.
Office Action dated Aug. 31, 2012, directed to Chinese Application No. 201110156242.6; 11 pages.

* cited by examiner

*Primary Examiner* — Quana M Grainger
(74) *Attorney, Agent, or Firm* — Morrison & Foerster LLP

(57) ABSTRACT

Provided is a housing that encloses: a first developer transport member that transports developer, which includes toner, laterally in a first direction; a second developer transport member that transports the developer in a second direction opposite to the first direction; a first communication passage configured to direct the developer transported by the first developer transport member to an upstream edge, along the second direction, of the second developer transport member; and a second communication passage configured to direct the developer transported by the second developer transport member to an upstream edge, along the first direction, of the first developer transport member. The second communication passage progressively reduces the amount of developer directed through the second communication passage to the upstream edge of the first developer transport member as an inclination angle of the housing increases so that the second communication passage is lower than the first communication passage.

9 Claims, 11 Drawing Sheets

DEVELOPING DEVICE WITH IMPROVED DEVELOPER TRANSPORT EFFICIENCY

This application is based on an application No. 2010-062744 filed in Japan, the contents of which are hereby incorporated by reference.

BACKGROUND OF THE INVENTION (1) Field of the Invention

The present invention relates to a developing device for developing an electrostatic latent image on a photoreceptor and to a process unit and an image forming apparatus that include the developing device.

(2) Description of the Related Art

Electrophotographic image forming apparatuses, such as a printer, copying machine, etc. normally function as follows. A developing device forms a toner image corresponding to image data on a photoreceptor drum. The toner image is then transferred to a recording sheet, such as recording paper, an OHP sheet, etc., either directly or indirectly via a component such as an intermediate transfer belt. Finally, a fixing device fixes the toner image to the recording sheet.

The developing device may use either mono-component developer, which includes only toner, or two-component developer, which includes toner and magnetic carrier. A developing device that uses two-component developer is normally provided with a developing roller, a feed screw, and a mixing screw inside housing that contains the two-component developer. The developing roller develops the electrostatic latent image on the photoreceptor drum. The mixing screw supplies the feed screw with two-component developer, and the feed screw feeds the developing roller with the two-component developer. The photoreceptor drum, feed screw, and mixing screw are parallel to each other in an approximately horizontal position.

The two-component developer in the housing is stirred and mixed during transport by the mixing screw. As a result, the toner becomes statically charged. Statically charged toner is transported along with the carrier to the feed screw. The feed screw transports the two-component developer in the opposite direction as the mixing screw. Toner and carrier transported by the feed screw are provided to the developing roller.

Carrier provided to the developing roller forms a magnetic brush on the peripheral surface of the developing roller. Toner that adheres to the magnetic brush develops the electrostatic latent image on the photoreceptor drum. Toner and carrier that are not provided to the developing roller are transported from a downstream edge of the feed screw to an upstream edge of the mixing screw, the terms downstream and upstream referring to the direction of transport of each of the screws. The mixing screw and the feed screw thus circulate toner and carrier through the inside of the housing.

In order to provide the photoreceptor drum with a constant amount of developer, it is preferable for the photoreceptor drum, developing roller, feed screw, and mixing screw in the image forming apparatus to be arranged in a horizontal position. When the image forming apparatus is not placed horizontally, the developer in the housing tends to accumulate in one location, causing the amount of developer provided to the photoreceptor drum not to be constant. The quality of the toner image formed on the photoreceptor drum may therefore degrade.

For example, if the developing device is inclined so that the upstream edge of the mixing screw is positioned lower than a downstream edge of the mixing screw (respectively corresponding to the downstream edge and an upstream edge of the feed screw), the developer in the housing flows to and accumulates at the upstream edge of the mixing screw (i.e. the downstream edge of the feed screw).

The mixing screw is provided in a mixing chamber, and when the developing device is thus inclined, the upper level of the developer in the mixing chamber rises higher than the transport range of the mixing screw at the upstream edge. The mixing screw therefore cannot stably transport developer that accumulates in this area to the upstream edge of the feed screw. Accordingly, the amount of developer transported to the feed screw decreases, which results in a decrease in the amount of developer fed to the developing roller. Toner thus cannot be stably fed to the photoreceptor drum.

In recent years, demand has increased for compact, lower-cost image forming apparatuses. The size of image forming apparatuses has been reduced by making developing devices smaller through a decreased amount of developer in the housing of the developing device and a reduction in size of the mixing screw and other components. Even when the developing device is positioned horizontally, i.e. not inclined, the amount of developer transported by the feed screw in such a compact image forming apparatus is decreased.

Accordingly, as described above, if the upstream edge of the mixing screw is positioned lower than the downstream edge, then even a slight inclination angle has a higher probability of impeding transport by the feed screw of a predetermined amount of developer. If the predetermined amount of developer is not transported to the developing roller, excellent development of the electrostatic latent image on the photoreceptor drum may not be possible.

Patent Literature 1 (Japanese Patent Application Publication No. 2001-117337) discloses providing a rectifying fin on the peripheral surface of a developing sleeve to rectify developer that flows in the direction in which the developing device is inclined. The rectifying fin redirects the developer towards the central region of the direction of transport of the developing sleeve.

Furthermore, Patent Literature 2 (Japanese Patent Application Publication No. 2002-278270) discloses providing a transport screw, fins, and a balancer. The transport screw transports, in the direction of the axis of the developing roller, developer that is removed from the developing roller by a doctor blade. The fins are provided in a separator that causes the transport screw to transport developer downstream. The fins are at an incline and guide developer to an upstream edge of the transport screw. Depending on where the developer accumulates, the balance changes the inclination of the fins.

The structures disclosed in Patent Literature 1 and 2 make the amount of developer transported from the feed screw to the peripheral surface of the developing sleeve uniform when the developing sleeve is inclined in a predetermined position. However, neither of the structures in Patent Literature 1 and 2 overcomes the problem of decreased transport efficiency by the mixing screw when the upstream edge of the mixing screw is lower than the downstream edge.

SUMMARY OF THE INVENTION

The present invention has been conceived in light of the above problem, and it is an object thereof to provide a developing device that circulates developer via a first developer transport member and a second developer transport member that transport developer in opposite horizontal directions, as do a mixing screw and a feed screw, and that does not exhibit decreased transport efficiency of the developer even when the transport directions of the first and second developer transport members are inclined with respect to the horizon. Another object of the present invention is to provide a process unit and an image forming apparatus that include the developing device.

In order to achieve the above objects, according to the present invention, a developing device for developing an electrostatic image on a photoreceptor using toner comprises: a mixing chamber including a first developer transport member that transports developer, which includes the toner, laterally in a first direction; a feed chamber including a second developer transport member that transports the developer in a second direction opposite to the first direction; a housing that encloses the mixing chamber and the feed chamber; and a developing roller provided in the feed chamber and configured to receive the developer transported by the second developer transport member and to develop the electrostatic image, wherein the housing includes: a first communication passage configured to direct the developer transported by the first developer transport member to an upstream edge, along the second direction, of the second developer transport member; and a second communication passage configured to direct the developer transported by the second developer transport member to an upstream edge, along the first direction, of the first developer transport member, and the second communication passage is configured to progressively reduce the amount of developer that is directed through the second communication passage to the upstream edge of the first developer transport member as an inclination angle of the housing increases so that the second communication passage is lower than the first communication passage.

A process unit according to the present invention includes the developing device.

An image forming apparatus according to the present invention includes the developing device.

BRIEF DESCRIPTION OF THE DRAWINGS

These and the other objects, advantages and features of the invention will become apparent from the following description thereof taken in conjunction with the accompanying drawings which illustrate specific embodiments of the invention.

In the drawings.

DESCRIPTION OF THE PREFERRED EMBODIMENTS

Embodiment 1

Figure 1:
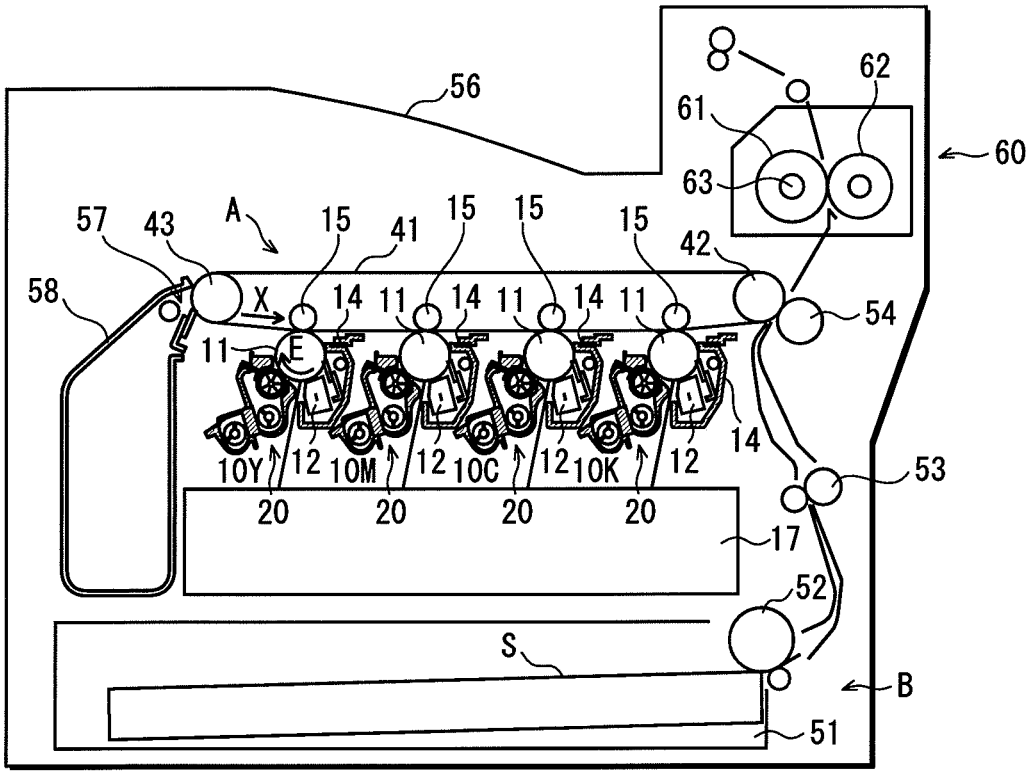
FIG. 1 is a schematic diagram showing an image forming apparatus, specifically a tandem-type color digital printer, provided with the developing device according to Embodiment 1 of the present invention.

FIG. 1 is a schematic diagram showing an image forming apparatus, specifically a tandem-type color digital printer (hereinafter simply referred to as "printer"), provided with the developing device according to Embodiment 1 of the present invention. Upon receiving a print job instruction, this printer uses known electrophotography to form a full-color or monochrome image on a recording sheet, such as recording paper or an OHP sheet, based on the print job instruction.

The printer is provided with an image forming unit A and a paper feed unit B located below the image forming unit A. The image forming unit A forms a toner image on a recording sheet via yellow (Y), magenta (M), cyan (C), and black (K) toners. The paper feed unit B is provided with a paper feed cassette 51 storing recording sheets S that are provided to the image forming unit A.

The image forming unit A is provided with a pair of belt conveyor rollers 42 and 43 and an intermediate transfer belt 41. The intermediate transfer belt 41 is wound around the belt conveyor rollers 42 and 43, so as to be positioned horizontally, and rotates around the rollers. The intermediate transfer belt 41 is rotated in the direction indicated by the arrow X by a motor not shown in the drawings.

Process units 10Y, 10M, 10C, and 10K are provided below the intermediate transfer belt 41 in this order, starting at the upstream end of the intermediate transfer belt 41. The process units 10Y, 10M, 10C, and 10K each form a toner image on the intermediate transfer belt 41 with yellow (Y), magenta (M), cyan (C), and black (K) toners respectively.

The process units 10Y, 10M, 10C, and 10K are each removable from the image forming unit A and are mounted in the image forming unit A by being inserted therein from the front of the image forming unit A towards the back. Upon reaching the end of its life, each of the process units 10Y, 10M, 10C, and 10K can be exchanged for a new process unit.

Apart from using a different color toner, the process units 10Y, 10M, 10C, and 10K have the same structure. Accordingly, the following description mainly focuses on the process unit 10Y.

The process unit 10Y is provided with a photoreceptor drum 11 positioned horizontally with respect to the intermediate transfer belt 41. The photoreceptor drum 11 extends lengthwise along the direction of width of the intermediate transfer belt 41, in a straight line from the front side of the printer to the back side of the printer. Each of the photoreceptor drums 11 rotates in the direction indicated by the arrow E.

An exposure device 17 is provided below the process units 10Y, 10M, 10C, and 10K and shines laser light on the surface of the photoreceptor drum 11 in each of the process units 10Y, 10M, 10C, and 10K to form an electrostatic latent image. The exposure device 17 is attached to the image forming unit A.

A charging device 12 is provided in the process unit 10Y to uniformly charge the facing surface of the photoreceptor drum 11. The charging device 12 faces the photoreceptor drum 11 and is positioned near the upstream edge, in the direction of rotation, of the surface portion of the rotating photoreceptor drum 11 that receives laser light from the exposure device 17. An electrostatic latent image is formed by the laser light from the exposure device 17 on the surface of the photoreceptor drum 11, which has been charged by the charging device 12.

A developing device 20 is located at the downstream edge, in the direction of rotation, of the surface portion of the rotating photoreceptor drum 11 that receives laser light. The developing device 20 uses toner to develop the electrostatic latent image formed on the surface of the photoreceptor drum 11.

Downstream from the developing device 20 in the direction of rotation of the photoreceptor drum 11 (i.e. above the photoreceptor drum 11), a first transfer roller 15 is provided facing the photoreceptor drum 11 so as to sandwich the intermediate transfer belt 41. The toner image formed by the developing device 20 on the photoreceptor drum 11 is transferred to the outer circumferential surface of the intermediate transfer belt 41 by the first transfer roller 15. Note that the first transfer roller 15 is attached to the image forming unit A.

A first transfer roller 15 is provided above the photoreceptor drum 11 in each of the other process units 10M, 10C, and 10K to transfer the image formed on the respective photoreceptor drum 11 to the intermediate transfer belt 41. Each of the first transfer rollers 15 is attached to the image forming unit A. The toner image formed on each of photoreceptor drums 11 is transferred to the same region of the intermediate transfer belt 41 by the corresponding first transfer roller 15.

A cleaning device 14 is provided in each of the process units 10Y, 10M, 10C, and 10K to clean the surface of the corresponding photoreceptor drum 11 after the toner image is transferred to the intermediate transfer belt 41. The cleaning devices 14 are respectively provided in the process units 10Y, 10M, 10C, and 10K downstream, in the direction of rotation of the corresponding photoreceptor drum 11, from the position at which the toner image is transferred from the surface of the photoreceptor drum 11 to the intermediate transfer belt 41.

The intermediate transfer belt 41 transports the toner images transferred by the first transfer rollers 15 to the belt conveyor roller 42, which is located near the process unit 10K that uses color K toner. A second transfer roller 54 is provided facing the belt conveyor roller 42 with the intermediate transfer belt 41 therebetween. The second transfer roller 54 is pressed into contact with the intermediate transfer belt 41, thus forming a transfer nip that transfers the toner image to a recording sheet.

A recording sheet S in the paper feed cassette 51 provided in the paper feed unit is transported to the transfer nip by a paper feed roller 52. The recording sheet S is transported by a pair of timing rollers 53 at the same time that the toner image formed on the intermediate transfer belt 41 is transported to the transfer nip. The toner image formed on the intermediate transfer belt 41 is pressed into contact with the recording sheet S that passes through the transfer nip and is wholly transferred to the recording sheet S by the electrostatic force of the electrical field formed by the second transfer roller 54.

Note that the toner that forms the toner image on the intermediate transfer belt 41 is not completely transferred to the recording sheet by the electrostatic force of the second transfer roller 54. Rather, a portion of the toner may remain on the intermediate transfer belt 41. In this case, the residual toner on the intermediate transfer belt 41 is electrically or mechanically removed by a residual toner removal device 57. The residual toner removal device 57 is provided opposite the belt conveyor roller 43 that is located near the process unit 10Y, with the intermediate transfer belt 41 therebetween. The removed toner is accumulated as waste toner in a waste toner bottle 58.

The recording sheet S that has passed through the transfer nip is transported to a fixing unit 60 provided in the upper part of the image forming unit A. The fixing unit 60 is provided with a heat roller 61 and a pressure roller 62 that are pressed into contact with each other. A fixing nip is formed between the heat roller 61 and pressure roller 62 by the two rollers being pressed together. A heat lamp 63 is provided in the center of the shaft of the heat roller 61 in order to heat the heat roller 61.

The recording sheet S passes through the transfer nip, is transported to the fixing unit 60, and then is heated and pressed while passing through the fixing nip. This heating and pressing fixes the toner image on the recording sheet S. With the toner image fixed thereon by the fixing unit 60, the recording sheet S is ejected into a copy receiving tray 56 provided at an upper part of the printer. The side of the recording sheet S bearing the toner image faces down.

The developing device 20 provided in each of the process units 10Y, 10M, 10C, and 10K has the same structure, and a two-component developer (carrier and toner) is located in each of the developing devices 20. Each developing device 20 uses two-component developer to develop the electrostatic latent image formed on the corresponding photoreceptor drum 11 provided facing the developing device 20.

Figure 2:
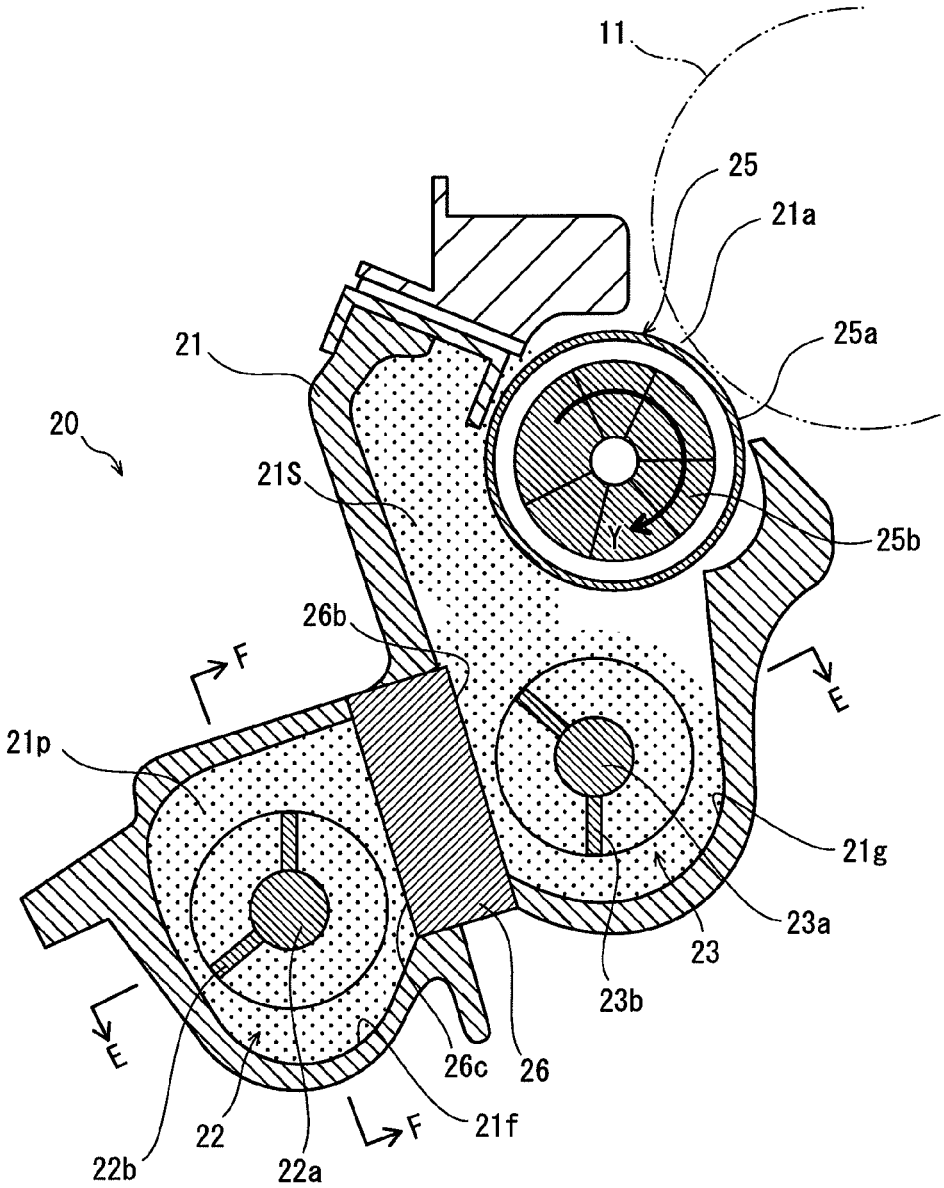
FIG. 2 is a cross-section diagram of the developing device provided in a process unit of the printer shown in FIG. 1.
Figure 3:
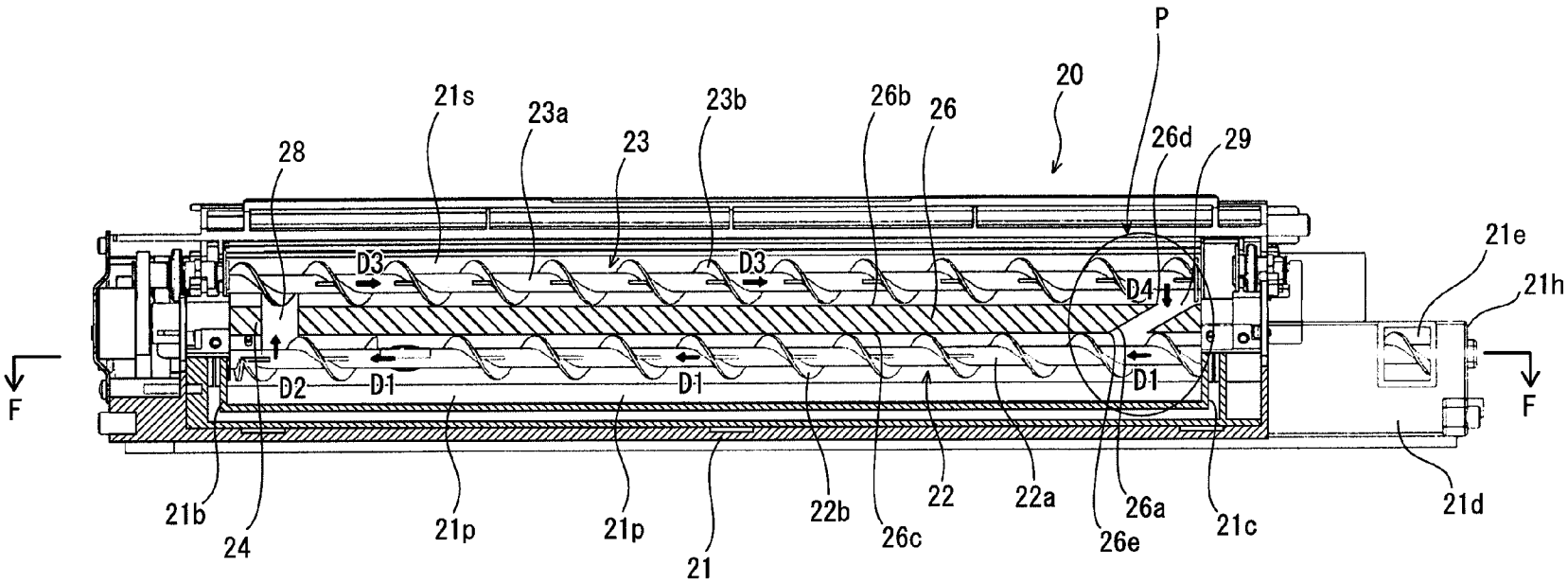
FIG. 3 is a perpendicular cross-section diagram along the line E-E in FIG. 2.
Figure 4:
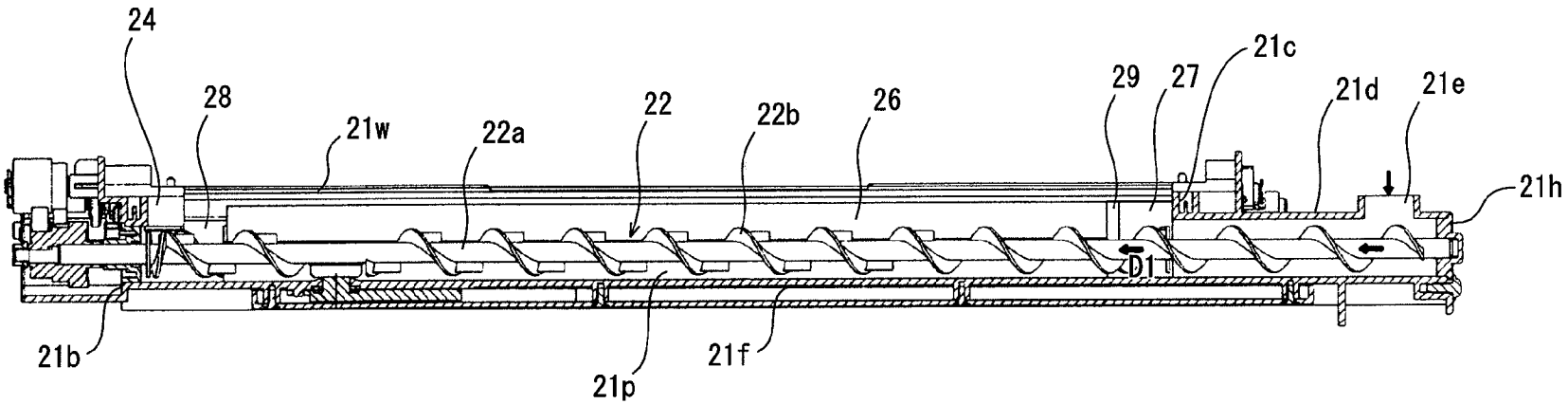
FIG. 4 is a perpendicular cross-section diagram along the line F-F in FIG. 2.

FIG. 2 is a cross-section diagram of the developing device 20. FIG. 3 is a perpendicular cross-section diagram along the line E-E in FIG. 2, and FIG. 4 is a perpendicular cross-section diagram along the line F-F in FIG. 2.

As shown in FIG. 2, the developing device 20 includes a housing 21 that extends along the length of the photoreceptor drum 11. The housing 21 contains the two-component developer, which includes toner and carrier. A feed chamber 21*s* and a mixing chamber 21*p* are provided inside the housing 21. The feed chamber 21*s* is provided near the photoreceptor drum 11, and the mixing chamber 21*p* is provided at a lower part of the housing 21, on the opposite side of the feed chamber 21*s* than the photoreceptor drum 11. The feed chamber 21*s* and the mixing chamber 21*p* are separated by a partition 26.

At an upper part of the feed chamber 21*s* in the housing 21, an opening 21*a* is provided facing a lower part of the outer circumferential surface of the photoreceptor drum 11. Also at the upper part of the feed chamber 21*s*, a developing roller 25 is provided facing the lower part of the outer circumferential surface of the photoreceptor drum 11 through the opening 21*a*. As the second developer transport member, a feed screw 23 is provided at a lower part of the feed chamber 21*s*, facing the developing roller 25.

Like a developing roller in a conventional developing device that uses two-component developer, the developing roller 25 includes a cylindrical developing sleeve 25*a* and a magnetic roller 25*b*. The developing sleeve 25*a* is provided parallel to the photoreceptor drum 11, and the magnetic roller 25*b* is provided in the developing sleeve 25*a*. The position of the magnetic roller 25*b* is fixed with respect to the housing 21, and the developing sleeve 25*a* is supported by the housing 21 so as to rotate about the magnetic roller 25*b*. The developing sleeve 25*a* rotates in the direction indicated by the arrow Y in FIG. 2.

As shown in FIG. 3, the feed screw 23 includes a rotating shaft 23*a* and a spiral transport blade 23*b*. The transport blade 23*b* is wound in a predetermined direction and is provided along the rotating shaft 23*a*, except at either edge thereof. The rotating shaft 23*a* is parallel to the developing sleeve 25*a*, which is in a horizontal position. The edges of the rotating shaft 23*a* are rotatably supported by faces 21*b* and 21*c* of the housing 21. The face 21*b* is at the front of the printer (hereinafter "front face"), and the face 21*c* is at the back of the printer (hereinafter "back face").

The rotating shaft 23*a* rotates in a predetermined direction due to a turning force. When the rotating shaft 23*a* rotates in the predetermined direction, the transport blade 23*b* rotates along with the rotating shaft 23*a*, and developer is transported in the horizontal direction indicated by the arrow D3 in FIG. 3. A portion of the developer transported by the transport blade 23*b* is provided to the outer circumferential surface of the developing sleeve 25*a*.

As shown in FIG. 2, a mixing screw 22 is provided in the mixing chamber 21*p* as the first developer transport member. The mixing screw 22 is positioned close to and diagonally lower than the feed screw 23, with the partition 26 therebetween. The mixing screw 22 is parallel to the feed screw 23 with respect to the horizon. The axis of the mixing screw 22 is located on a plane that forms approximately a 15° angle, for example, with respect to a horizontal plane that traverses the axis of the feed screw 23.

As shown in FIG. 3, the partition 26 is in the form of a plate, extending in the direction of length of the mixing chamber 21*p* and the feed chamber 21*s*. The direction of width of the partition 26 (perpendicular to the directions of length and thickness) is perpendicular to a plane that traverses the axes of both the mixing screw 22 and the feed screw 23. Accordingly, the direction of width of the partition 26 is inclined at approximately a 15° angle with respect to a vertical plane.

The partition 26 has a constant thickness throughout (10 mm in Embodiment 1), and the surface facing the inside of the feed chamber 21*s* (feed chamber inner surface 26*b*) and the surface facing the inside of the mixing chamber 21*p* (mixing chamber inner surface 26*c*) are parallel. Accordingly, the feed chamber inner surface 26*b* and the mixing chamber inner surface 26*c* are both inclined at approximately a 15° angle with respect to the vertical plane.

As shown in FIGS. 3 and 4, the mixing screw 22 provided in the mixing chamber 21*p* is longer than the feed screw 23 and includes a rotating shaft 22*a* and a spiral transport blade 22*b*. One edge (front edge) of the rotating shaft 22*a* is rotatably supported by the front face 21*b* of the housing 21. The transport blade 22*b* is wound along the rotating shaft 22*a*, except at either edge thereof. The transport blade 22*b* is wound in a spiral in the same direction as the transport blade 23*b* of the feed screw 23.

The back edge of the rotating shaft 22*a* of the mixing screw 22 is located nearer the back of the printer than the back face 21*c* of the housing 21 and is covered by a cylindrical casing 21*d*. The casing 21*d* is integrated into the back face 21*c* that supports the rotating shaft 23*a* of the feed screw 23. A back edge of the rotating shaft 22*a* of the mixing screw 22 is rotatably supported by a back face 21*h* of the casing 21*d*. A feed port 21*e* is provided at the top of the casing 21*d* for toner fed by a toner transport tube (not shown in the figures).

The rotating shaft 22*a* of the mixing screw 22 rotates in the opposite direction as the rotating shaft 23*a* of the feed screw 23. The transport blade 22*b* of the mixing screw 22 rotates along with the rotating shaft 22*a*, thereby transporting developer in the mixing chamber 21*p* in the opposite direction as the direction in which the feed screw 23 transports developer, i.e. in the approximately horizontal direction indicated by the arrow D1 in FIG. 3.

As shown in FIG. 2, a bottom 21*f* of the mixing chamber 21*p* is semi-cylindrical, in accordance with the region in which the transport blade 22*b* of the mixing screw 22 rotates. A bottom 21*g* of the feed chamber 21*s* is also semi-cylindrical, in accordance with the region in which the transport blade 23*b* of the feed screw 23 rotates. The bottom 21*f* of the mixing chamber 21*p* and the bottom 21*g* of the feed chamber 21*s* both connect with the partition 26.

The bottom 21*f* of the mixing chamber 21*p* is continuous with a lower part of the cylindrical casing 21*d*, i.e. a semi-cylindrical circumferential portion of the casing 21*d*. The inside of the casing 21*d* forms part of the mixing chamber 21*p*. Through the feed port 21*e* provided at the top of the casing 21*d*, toner flows into the casing 21*d* at the upstream edge of the mixing screw 22, flowing into the region in which the transport blade 22*b* of the mixing screw 22 rotates.

Toner that is fed at the upstream edge of the mixing screw 22 is transported by rotation of the mixing screw 22. Toner is transported together with developer in the mixing chamber 21*p* horizontally along the rotating shaft 22*a* towards the front face 21*b* of the housing 21, as indicated by the arrow D1 in FIG. 3. The developer is thus transported to the downstream edge of the mixing screw 22.

As shown in FIG. 3, a first communication passage 28 and a second communication passage 29 are provided in the housing 21 at both sides of the partition 26 in a direction of length, in order to connect the inside of the mixing chamber 21*p* to the inside of the feed chamber 21*s*. The first communication passage 28 faces the downstream edge of the mixing screw 22 (first developer transport member) and the upstream edge of the feed screw 23 (second developer transport member). Conversely, the second communication passage 29 faces the upstream edge of the mixing screw 22 and the downstream edge of the feed screw 23.

At the downstream edge of the mixing screw 22 in the mixing chamber 21*p*, developer transported by the mixing screw 22 traverses the first communication passage 28, as indicated by the arrow D2 in FIG. 3, and is fed to the feed chamber 21*s*. Developer fed to the feed chamber 21*s* is transported by the feed screw 23 in the direction indicated by the arrow D3 in FIG. 3. During transport, a portion of the developer is provided to the outer circumferential surface of the developing sleeve 25*a* in the developing roller 25.

Developer not fed to the developing sleeve 25*a* by the feed screw 23 is transported to the downstream edge of the feed screw 23. At the downstream edge, the developer flows in the direction indicated by the arrow D4 in FIG. 3 into and through the second communication passage 29, thus being fed to the mixing chamber 21*p*. Developer fed to the mixing chamber 21*p* is transported by the mixing screw 22 towards the first communication passage 28. Developer thus circulates through the housing 21.

Due to magnetic properties of the magnetic roller 25*b*, developer that is provided to the developing roller 25 by the feed screw 23 forms a magnetic brush on the outer circumferential surface of the developing sleeve 25*a*, which rotates around the fixed magnetic roller 25*b*. The toner attached to the magnetic brush attaches to the electrostatic latent image on the photoreceptor drum 11. The electrostatic latent image is thereby developed with toner.

Note that during such development, the concentration of toner in the developer stored in the housing 21 is detected by, for example, a magnetic sensor (not shown in the figures). If the concentration is below a predetermined level, toner is fed via a toner transport tube (not shown in the figures) from a corresponding toner cartridge (not shown in the figures) to the feed port 21*e* provided in the casing 21*d* of the housing 21.

The first communication passage 28 is provided between (i) one edge of the partition 26 in the direction of length thereof near the upstream edge of the feed screw 23 and (ii) a guide member 24 provided at the front face 21*b* of the housing 21. The central axis of the first communication passage 28 is perpendicular to the directions of length of the mixing screw 22 and the feed screw 23. The width of the first communication passage 28 is constant along the edge of the partition 26.

Figure 5:
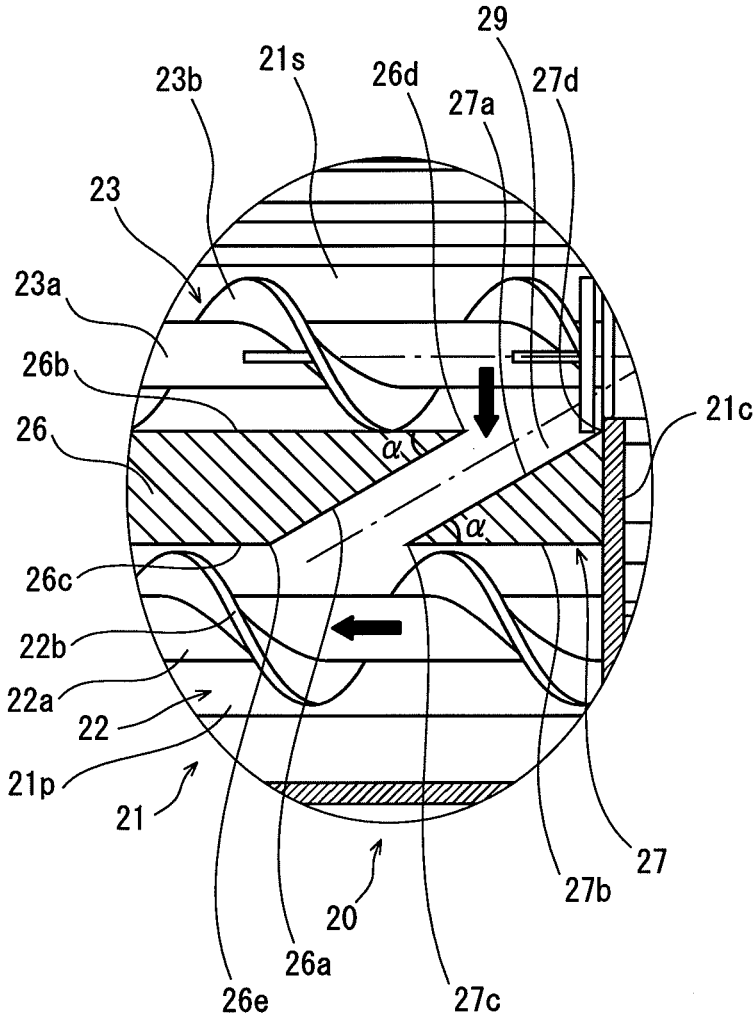
FIG. 5 is an enlarged diagram of a principal part shown by the letter P in FIG. 3.

FIG. 5 is an enlarged diagram of a principal part shown by the letter P in FIG. 3. As shown in FIG. 5, the second communication passage 29 is formed between (i) an edge of the partition 26 in the direction of length thereof near the downstream edge of the feed screw 23 and (ii) a guide member 27 provided at the back face 21*c* of the housing 21 facing this edge of the partition 26. The dimensions of the guide member 27 in the directions of thickness and width of the partition 26 are equal to the corresponding dimensions of the partition 26, and the guide member 27 is provided across from the partition 26.

At the downstream edge of the feed screw 23, the guide member 27 has a flat guiding surface (inner surface) 27*a* to guide developer to the mixing chamber 21*p* after the developer flows into the second communication passage 29. The guiding surface 27*a* is one of the two inner surfaces of the second communication passage 29. The guide member 27 also has a lateral surface 27*b* that is located along the same plane as the mixing chamber inner surface 26*c* of the partition 26. With respect to the lateral surface 27*b*, the guiding surface 27*a* is inclined at a predetermined acute angle α. Note that the guiding surface 27*a* abuts the back face 21*c* of the housing 21 on the side of the feed chamber 21*s*.

The partition 26 has a flat opposing surface (inner surface) 26*a* that faces the guiding surface 27*a* with the second communication passage 29 therebetween. With respect to the feed chamber inner surface 26*b* of the partition 26, the opposing surface 26*a* is inclined at the predetermined acute angle α. The guiding surface 27*a* and the opposing surface 26*a* are parallel to each other, and accordingly, the opposing surface 26*a* is included at an obtuse angle (180°−α) with respect to the mixing chamber inner surface 26*c* of the partition 26.

Developer that is transported by the feed screw 23 in the feed chamber 21*s* flows into the second communication passage 29 and then flows through the second communication passage 29 towards the mixing chamber 21*p*. The central axis of the second communication passage 29 is parallel to the guiding surface 27*a* and the opposing surface 26*a* and is therefore inclined at the predetermined angle α with respect to the feed chamber inner surface 26*b* of the partition 26. Accordingly, developer that flows into the second communication passage 29 is guided in the direction of the central axis of the second communication passage 29, and upon reaching the mixing chamber 21*p*, the developer then flows towards the first communication passage 28.

The second communication passage 29 has an inlet, into which developer flows, facing the feed chamber 21*s*. The inlet is defined by a first inflow edge 26*d* and a second inflow edge 27*d*. The first inflow edge 26*d* is the edge formed where the feed chamber inner surface 26*b* of the partition 26 and the opposing surface 26*a* meet at the predetermined angle α, and the second inflow edge 27*d* is the edge formed where the guiding surface 27*a* of the guide member 27 and the back face 21*c* of the housing 21 meet.

The second communication passage 29 has an outlet, out of which developer flows, facing the mixing chamber 21*p*. The output opening is defined by a first outflow edge 26*e* and a second outflow edge 27*c*. The first outflow edge 26*e* is the edge formed where the mixing chamber inner surface 26*c* of the partition 26 and the opposing surface 26*a* meet, and the second outflow edge 27*c* is the edge formed where the guiding surface 27*a* of the guide member 27 and the lateral surface 27*b* of the guiding surface 27*a* meet.

In the second communication passage 29 in Embodiment 1, the first inflow edge 26*d* is located further downstream in the transportation direction of the feed screw 23 (upstream in the transportation direction of the mixing screw 22) than the second outflow edge 27*c*. Therefore, the second outflow edge 27*c* is closer to the first communication passage 28 than the first inflow edge 26*d*.

A printer with developing devices 20 having the above structure is usually placed in a room within an office or similar location so that the axes of the photoreceptor drums 11 (the main scanning direction) in the process units 10Y, 10M, 10C, and 10K are horizontal. However, rather than being placed horizontally, the printer may be positioned at an incline, with the front side higher than the back side. In this case, each of the developing devices 20 is therefore positioned at the same incline.

The central axis of the second communication passage 29 is inclined so that the central axis gradually approaches the first communication passage 28 from the inlet at the feed chamber 21*s* towards the outlet at the mixing chamber 21*p*. Therefore, when the housing 21 is inclined so that the first communication passage 28 is higher than the second communication passage 29 as in the above case, the inclination of the central axis of the second communication passage 29 decreases with respect to the horizon.

The flow of developer from the feed chamber 21*s* through the second communication passage 29 into the mixing chamber 21*p* per unit time thus decreases. As a result, the problem of developer accumulating near the second communication passage 29 in the mixing chamber 21*p* does not occur, unlike in a conventional configuration. Accordingly, developer is smoothly transported by the mixing screw 22 without the problem, which occurs in a conventional developing device, of difficulty in transporting developer located at the back of the mixing screw 22.

As a result, there is no risk of a decrease in the amount of developer flowing from the mixing chamber 21*p* through the first communication passage 28 to the feed chamber 21*s*. Developer is thus stably fed by the feed screw 23 in the feed chamber 21*s* to the developing sleeve 25*a* in the developing roller 25. Excellent development of the electrostatic latent image on the photoreceptor drum 11 is thus achieved by the developing sleeve 25*a* with the toner fed thereto.

Note that in the developing device 20 in Embodiment 1, the mixing screw 22 is positioned diagonally lower than, and parallel to, the feed screw 23 (see FIG. 2). However, the developing device 20 is not limited to this structure. The mixing screw 22 may be positioned vertically below the feed screw 23, or the mixing screw 22 and the feed screw 23 may be positioned parallel to each other in a horizontal plane.

If the mixing screw 22 is positioned vertically below the feed screw 23, a cross-section diagram of a plane perpendicular to the horizon traversing the axis of both the mixing screw 22 and the feed screw 23 is the same as the diagram in FIG. 5.

In this case as well, when the housing 21 in the developing device 20 is inclined so that the first communication passage 28 is higher than the second communication passage 29, the inclination of the central axis of the second communication passage 29 decreases with respect to the horizon. The amount of developer flowing from the feed chamber 21*s* through the second communication passage 29 to the mixing chamber 21*p* thus decreases. As a result, the amount of developer in the feed chamber 21*s* does not decrease, and developer is stably fed to the developing sleeve 25*a* in the developing roller 25.

If the developing device 20 is structured so that the mixing screw 22 and the feed screw 23 are positioned parallel to each other in a horizontal plane, then in this case as well, when the housing 21 is inclined so that the first communication passage 28 is higher than the second communication passage 29, the outlet of the second communication passage 29 located at the side of the mixing chamber 21*p* rises a greater amount than the inlet located at the side of the feed chamber 21*s*, since the outlet is closer to the first communication passage 28.

As a result, developer does not unnecessarily accumulate at the back of the mixing screw 22 due to a greater flow of developer than the transport ability of the mixing screw 22, a situation which would cause a reduction in the total amount of developer in circulation. Rather, the amount of developer flowing from the feed chamber 21*s* to the mixing chamber 21*p* decreases. Accordingly, the amount of developer in the feed chamber 21*s* does not decrease, and developer is stably fed to the developing sleeve 25*a* in the developing roller 25.

An experiment was performed on the developing device 20 according to Embodiment 1, the developing device 20 having been structured so that the mixing screw 22 was located vertically below the feed screw 23 (FIG. 5 showing a perpendicular cross-section diagram that traverses the mixing screw 22 and the feed screw 23). The experiment was performed under the following conditions to test whether feeding developer to the developing sleeve 25*a* in the developing roller 25 becomes problematic when the housing 21 is inclined so that the first communication passage 28 is higher than the second communication passage 29.

An aluminum (Al) cylinder with an outside diameter of 16 mm was used as the developing sleeve 25*a* in the developing roller 25. Sandblasting was performed on the outer circumferential surface of the developing sleeve 25*a*. The rotation frequency of the developing sleeve 25*a* was set to 360 rpm.

The feed screw 23 was formed by a rotating shaft 23*a* with a diameter of 6 mm and a spiral transport blade 23*b* with a diameter (screw diameter) of 14 mm and a pitch of 25 mm. The rotation frequency of the feed screw 23*a* was set to 340 rpm.

The mixing screw 22 was formed with the same structure as the feed screw 23. However, so that developer would be transported in the opposite direction, the spiral transport blade 22*b*, which faced the same direction as the transport blade 23*b* in the feed screw 23, was rotated in the opposite direction as the transport blade 23*b*.

The developer was composed of ferrite core carrier, having a mean particle diameter of 33 μm and to which acrylic Micro Engineering Coating (MEC) was applied, and toner having a mean particle diameter of 6.5 μm manufactured by emulsion polymerization of a styrene acrylic resin. The developer had a toner concentration of 7%, with 200 g of toner stored in the housing 21.

The openings of the first communication passage 28 were 37 mm×16 mm rectangles, and the openings of the second communication passage 29 were 10 mm×10 mm squares. The second communication passage 29 was formed at an inclination of 30° with respect to the axis of the feed screw 23.

Under the above conditions, the housing 21 in the developing device 20 was inclined so that the first communication passage 28 was positioned both higher and lower than the second communication passage 29, and the amount of developer fed to the developing sleeve 25*a* was tested as the inclination was varied. Note that determination of the amount of developer fed to the developing sleeve 25*a* was based on the amount of developer that attached to the outer circumferential surface of the developing sleeve 25*a*. The graph in FIG. 6 shows the results of the experiment.

Figure 6:
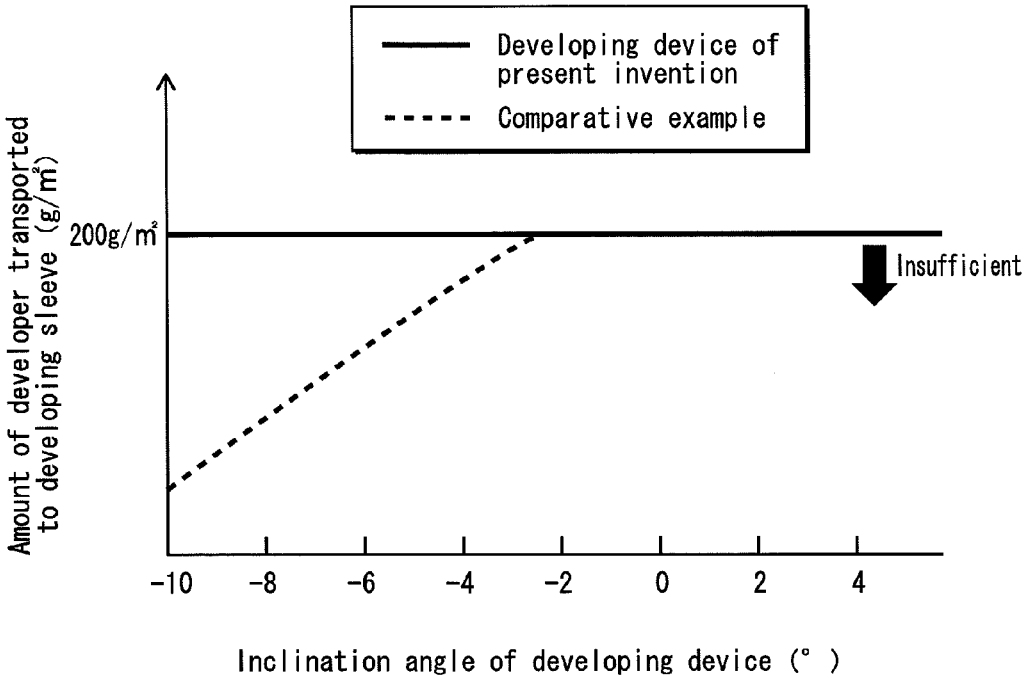
FIG. 6 is a graph showing experimental results on the adequacy of the amount of developer fed to the developing sleeve when the developing device according to Embodiment 1 is inclined at predetermined angles.

The graph in FIG. 6 shows both the case when the first communication passage 28 was positioned higher than the second communication passage 29, as well as the opposite case when the second communication passage 29 was positioned higher than the first communication passage 28, respectively indicated by a negative and a positive inclination angle. Note that when the amount of toner transported to the outer circumferential surface of the developing sleeve 25*a* is equal to or less than 200 g/m$^2$, the feed of developer to the developing sleeve 25*a* was considered insufficient.

As the graph in FIG. 6 shows, even at an inclination angle of the developing device 20 of −10°, the problem of insufficient feed of developer to the developing sleeve 25*a* did not occur. However, at an inclination angle of less than −10°, developer that accumulated near the second communication passage 29 on the side of the feed chamber 21*s* flowed out through the opening 21*a* in the housing 21, i.e. the opening into which the developing roller 25 fits.

For comparison, an experiment was performed under the same conditions as the above experiment using a developing device structured in the same way as the developing device 20 used in the above experiment, with the exception that the guiding surface 27*a* facing the second communication passage 29 was formed to be perpendicular to the transport directions of the mixing screw 22 and the feed screw 23. The dashed line (comparative example) in the graph in FIG. 6 indicates the experimental results. In this case, the feed of developer to the developing sleeve 25*a* was insufficient when the inclination angle of the housing was below −2°.

Note that when the mixing screw 22 is positioned vertically below the feed screw 23 in the developing device 20, it is preferable that the second outflow edge 27*c* (which is along the guiding surface 27*a* at the side of the mixing chamber 21*p*, i.e. located at the upstream edge of the mixing screw 22) be positioned closer to the first communication passage 28 than the first inflow edge 26*d* (which is along the opposing surface 26*a* that faces the second communication passage 29, i.e. located at the downstream edge of the feed screw 23), as in Embodiment 1.

With this structure, if the housing 21 in the developing device 20 is inclined so that the second communication passage 29 is positioned higher than the first communication passage 28, then developer flows through the second communication passage 29 at a reduced speed, since the inclination angle of the guiding surface 27*a*, which the developer hits and flows along, is smaller with respect to the horizon. The amount of developer fed from the feed chamber 21*s* to the mixing chamber 21*p* per unit time thus decreases.

Note that Embodiment 1 is not limited to this structure. The second outflow edge 27*c* along the guiding surface 27*a* may be positioned closer to the downstream edge of the feed screw 23 (the upstream edge of the mixing screw 22) than the first inflow edge 26*d* along the opposing surface 26*a* that faces the second communication passage 29.

Figure 7:
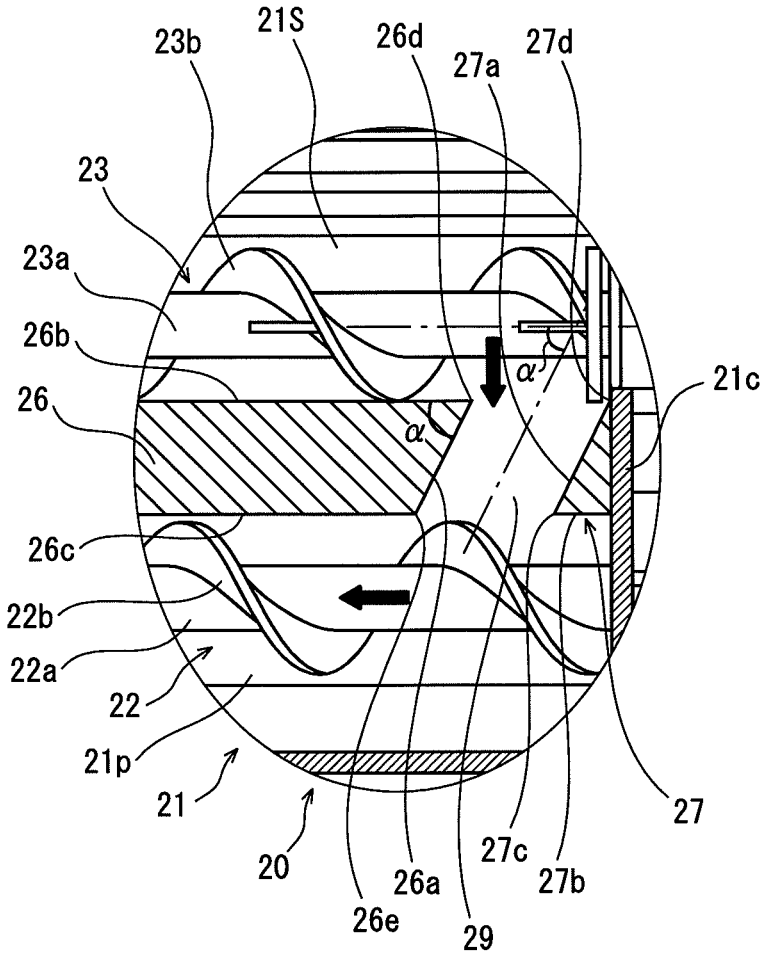
FIG. 7 is a cross-section diagram of the principal part in a modification of the developing device according to Embodiment 1.
Figure 8:
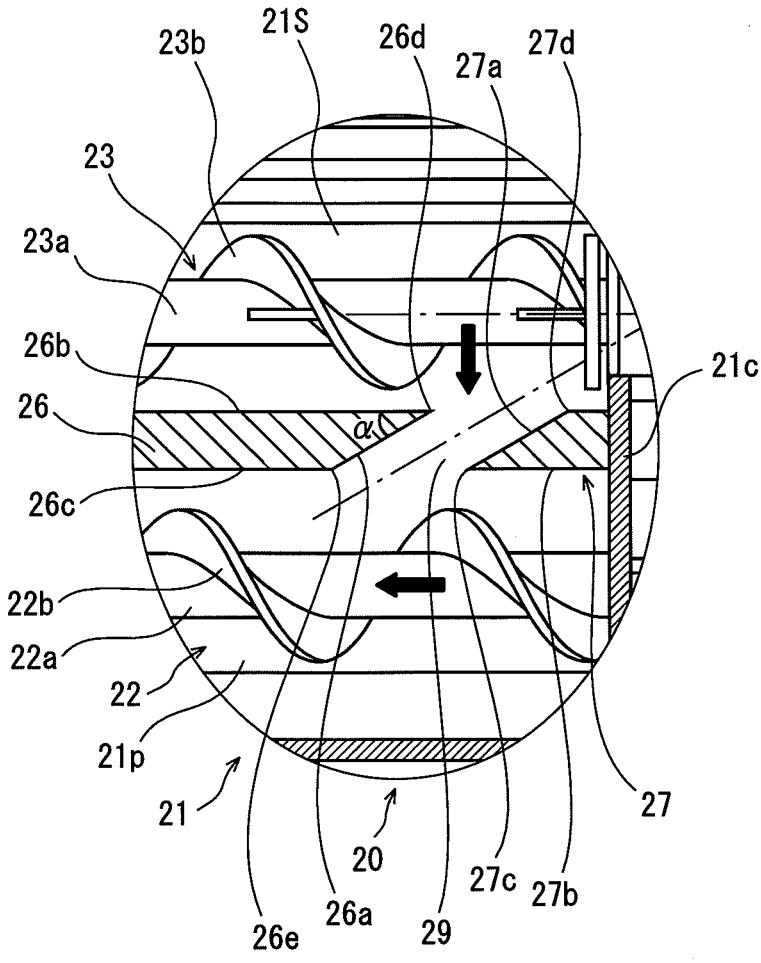
FIG. 8 is a cross-section diagram of the principal part in another modification of the developing device according to Embodiment 1.

FIGS. 7 and 8 show examples of a second communication passage 29 with this structure. FIG. 7 shows a developing device 20 in which the mixing screw 22 is positioned vertically below the feed screw 23, and the inclination angle of the guiding surface 27*a* with respect to the axis of the feed screw 23 is 180°-60° (accordingly, the inclination angle of the opposing surface 26*a* with respect to the axis of the feed screw 23 is 60°). Furthermore, the opposing surface 26*a* facing the second communication passage 29 does not vertically overlap with the guiding surface 27*a*.

FIG. 8 shows a developing device 20 in which the mixing screw 22 is positioned vertically below the feed screw 23, the thickness of the partition 26 is half (i.e. 5 mm) the thickness of the partition 26 in Embodiment 1, and the opposing surface 26*a* facing the second communication passage 29 does not vertically overlap with the guiding surface 27*a*.

In the developing device 20 structured as in FIGS. 7 and 8, the amount of developer that passes through the second communication passage 29 increases slightly over the developing device 20 in FIG. 5, yet the problem of insufficient toner fed to the developing sleeve 25*a* due to an inclination of the housing 21 is still controlled.

Figure 9:
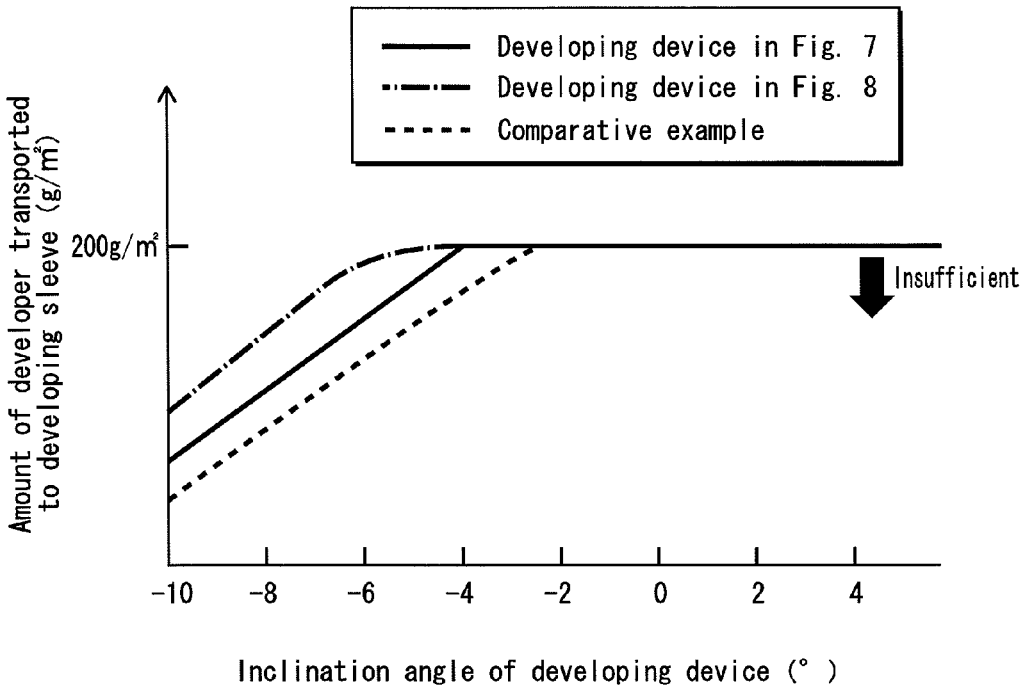
FIG. 9 is a graph showing experimental results on the adequacy of the amount of developer fed to the developing sleeve in the modifications of the developing device.

The same experiment as described above was also performed on the developing devices 20 structured as in FIG. 7 and as in FIG. 8 to test whether the problem of insufficient developer fed to the developing sleeve 25*a* occurred. The graph in FIG. 9 shows the results of the experiments. The solid line in the graph in FIG. 9 indicates the experimental results for the developing device 20 structured as in FIG. 7, and the alternating long and short dashed line indicates the experimental results for the developing device 20 structured as in FIG. 8. Note that the dashed line in the graph in FIG. 9 indicates the experimental results of the comparative example shown by the dashed line in the graph in FIG. 6.

In the case of the developing device 20 structured as in FIG. 7, when the inclination angle of the developing device 20 was below −4° as compared to the horizon, the problem of insufficient developer fed to the developing sleeve 25*a* occurred. This inclination angle, however, is still larger than the inclination angle of the developing device 20 in the comparative example at which the problem of insufficient developer fed to the developing sleeve 25*a* occurred (−2°).

In the case of the developing device 20 structured as in FIG. 8, when the inclination angle of the developing device 20 was below −5° as compared to the horizon, the problem of insufficient developer fed to the developing sleeve 25*a* occurred. In this case as well, however, this inclination angle is still larger than the inclination angle of the developing device 20 in the comparative example at which the problem of insufficient developer fed to the developing sleeve 25*a* occurred (−2°).

Note that in Embodiment 1, factors such as the amount of developer transported by the mixing screw 22 and the feed screw 23 in the developing device 20 vary depending on the structure and location of the mixing screw 22 and the feed screw 23, the position of the screws, the composition of the toner and the carrier, etc. Therefore, the inclination angle of the developing device 20 at which the problem of insufficient developer fed to the developing sleeve 25*a* occurs also varies. Therefore, the inclination angle, axis length, cross-sectional area, cross-sectional shape, etc. of the second communication passage 29 should be appropriately changed in accordance with factors such as the configuration of the mixing screw 22 and the feed screw 23.

For example, if the guiding surface 27*a* in the second communication passage 29 is perpendicular to the transport direction of the feed screw 23, then based on the inclination angle of the developing device 20 at which the problem of insufficient developer fed to the developing sleeve 25*a* occurs, the inclination angle of the second communication passage 29 with respect to the feed screw 23, the axis length and the cross-sectional area of the second communication passage 29, etc. may be determined.

Embodiment 2

Figure 10:
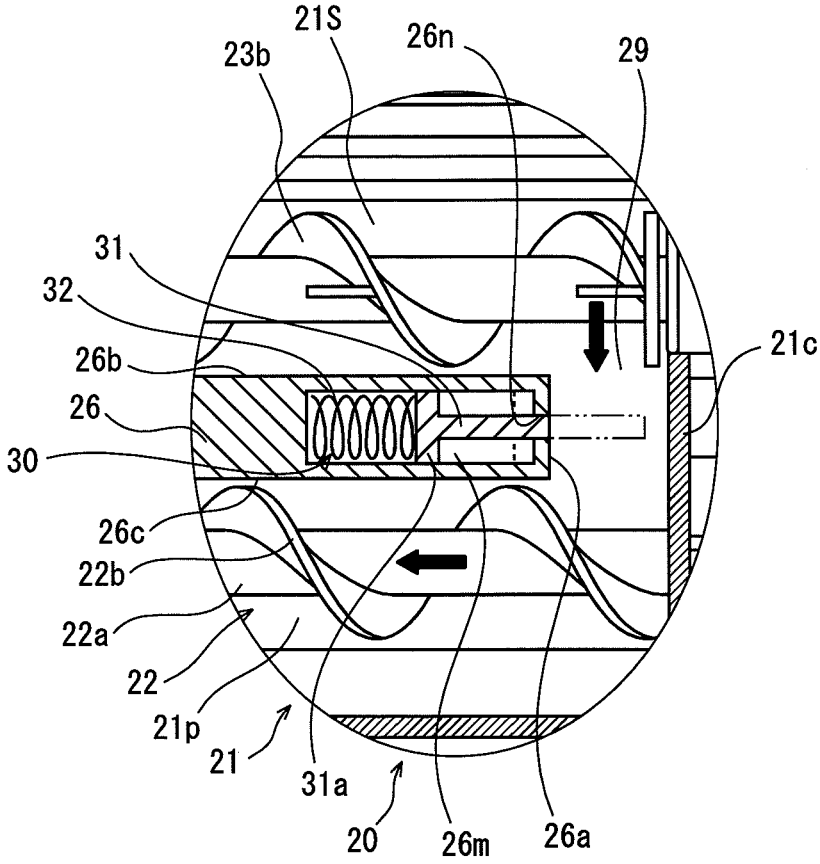
FIG. 10 is a cross-section diagram of the principal part in a developing device according to Embodiment 2 of the present invention.

FIG. 10 is a cross-section diagram of a second communication passage 29 in a developing device 20 according to Embodiment 2 of the present invention. In Embodiment 2, the mixing screw 22 is positioned vertically below the feed screw 23. Therefore, when the developing device 20 is positioned along the main scanning direction, the partition 26 is horizontal. The second communication passage 29 is provided between the back face 21*c* of the housing 21 and the opposing surface 26*a* of the partition 26. The opposing surface 26*a* of the partition 26 is parallel to the back face 21*c* of the housing 21.

A compartment 26*m* is formed inside the partition 26 at the back edge thereof. The compartment 26*m* is formed along almost the entire width of the partition 26. At the center, in the direction of width, of the side wall of the partition 26 constituting the opposing surface 26*a*, a communication aperture 26*n* is provided to connect the inside of the compartment 26*m* with the second communication passage 29. Inside the compartment 26*m*, an opening space reconfiguration unit 30 is provided. By changing the width of the opening of the second communication passage 29 in the direction of length of the partition 26, the opening space reconfiguration unit 30 changes the space through which the developer passes.

The opening space reconfiguration unit 30 includes a closure plate 31 that extends across almost the entire width of the partition 26. The closure plate 31 is disposed in the compartment 26*m* so as to be capable of parallel displacement in the direction of length of the partition 26. The closure plate 31 undergoes parallel displacement in the compartment 26*m* due to its own weight when the partition 26 is inclined so that the edge of the partition 26 containing the compartment 26*m* (by the second communication passage 29) is lowered. The closure plate 31 thus protrudes into the second communication passage 29 through the communication aperture 26*n* provided in the partition 26.

When the partition 26 is inclined so that the edge of the partition 26 containing the compartment 26*m* lowers, and the closure plate 31 protrudes through the communication aperture 26*n*, then the closure plate 31 partially closes off the second communication passage 29 on the side of the partition 26. The opening of the second communication passage 29 in the direction of length of the partition 26 (inclination direction) thus becomes smaller, decreasing the opening space in the second communication passage 29 through which the developer flows. The amount of developer flowing through the second communication passage 29 thus decreases.

A stopper 31*a* is provided on the closure plate 31 at the end of the closure plate 31 towards the back of the compartment 26*m*. The stopper 31*a* prevents the closure plate 31 from leaving the compartment 26*m* when a predetermined length of the closure plate 31 protrudes into the second communication passage 29 through the communication aperture 26*n*.

Note that it is preferable to set the dimensions of the stopper 31*a* so that the closure plate 31 does not completely cut off the second communication passage 29 even if the developing device 20 is inclined to a greater degree than assumed. If the second communication passage 29 is completely cut off by the stopper 31*a*, no developer will be transported to the mixing chamber 21*p*, causing developer to accumulate in the feed chamber 21*s* and likely causing the developing device 20 to break down.

An extension spring 32 is provided inside the compartment 26*m* as a biasing means to provide a bias force to the closure plate 31 in the compartment 26*m*. The extension spring 32 is provided, for example, at the center of the direction of width of the partition 26. One edge of the extension spring 32 is attached to the back surface of the compartment 26*m*, and the other edge of the extension spring 32 is attached to the closure plate 31. The spring constant of the extension spring 32 is set to a predetermined value so that, when the partition 26 is inclined so that the edge of the partition 26 containing the compartment 26*m* (by the second communication passage 29) lowers, the length of the closure plate 31 protruding into the second communication passage 29 increases by 1 mm each time the inclination angle increases by one degree.

Figure 11:
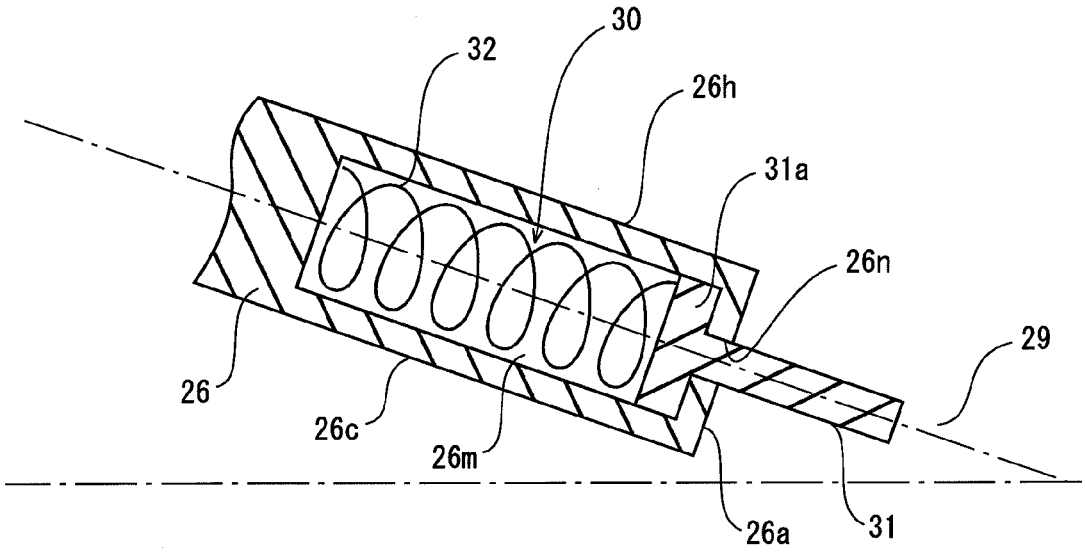
FIG. 11 is a cross-section diagram of the principal part to illustrate the operation of the developing device shown in FIG. 10.

In a developing device 20 with the above structure, when the housing 21 in the developing device 20 is inclined so that the first communication passage 28 is higher than the second communication passage 29, a gravitational force proportional to the inclination angle is exerted on the closure plate 31. As shown in FIG. 11, the gravitational force causes the closure plate 31 to protrude into the second communication passage 29 through the communication aperture 26*n*, shortening the width of the second communication passage 29 along the partition 26.

Since the spring constant of the extension spring 32 is set so that the length of the closure plate 31 protruding into the second communication passage 29 increases by 1 mm each time the inclination angle of the developing device 20 increases by one degree with respect to the horizon, the length of the closure plate 31 protruding into the second communication passage 29 increases proportionally to an increase in the inclination angle of the housing 21. Accordingly, as the inclination angle of the developing device 20 increases with respect to the horizon, the area of the second communication passage 29 that is cut off by the closure plate 31 increases.

Therefore, when the closure plate 31 protrudes into the second communication passage 29, a portion of the second communication passage 29 near the opposing surface 26*a* of the partition 26 is cut off, and the width of the second communication passage 29 along the direction of length of the partition 26 decreases. Since the length of the closure plate 31 protruding into the second communication passage 29 increases proportionally to an increase in the inclination angle of the housing 21 with respect to the horizon, the width of the second communication passage 29 also decreases proportionally to an increase in the inclination angle of the housing 21 with respect to the horizon.

As the width of the second communication passage 29 decreases, the amount of developer transported per unit of time from the feed chamber 21*s* through the second communication passage 29 to the mixing chamber 21*p* decreases. The amount of developer flowing through the second communication passage 29 into the mixing chamber 21*p* thus decreases. As a result, the problem of developer accumulating in the mixing chamber 21*p* by the second communication passage 29 does not exist, and the amount of developer transported by the mixing screw 22 to the feed chamber 21*s* does not decrease, as is also the case in the developing device 20 in Embodiment 1. Developer can thus be stably fed to the developing sleeve 25*a* in the developing roller 25.

The same experiment as performed on the developing device 20 in Embodiment 1 was also performed under the following conditions on the developing device 20 in Embodiment 2 to test whether the problem of insufficient toner fed to the developing sleeve 25*a* occurred.

The thickness (height in a vertical direction) of the partition 26 in the developing device 20 of Embodiment 2 was 10 mm. The length of the closure plate 31 in the direction of length of the partition 26 was 12 mm including the stopper 31*a* (10 mm excluding the stopper 31*a*). The thickness of the closure plate 31 (height in the vertical direction of the partition 26) excluding the stopper 31*a* was 4 mm. The length of the stopper 31*a* in the direction of length of the partition 26 was 2 mm, and the thickness of the stopper 31*a* (height in the vertical direction of the partition 26) was 6 mm. The closure plate 31 was made entirely of steel use stainless (SUS) and had a mass of 40 g.

The spring constant of the extension spring 32 was set to 0.0068 N/mm so that, when housing 21 in the developing device 20 was inclined so that the first communication passage 28 was higher than the second communication passage 29, the length of the closure plate 31 protruding into the second communication passage 29 increased by 1 mm for each degree of inclination angle (in this context, the inclination angle is negative).

In the developing device 20 in Embodiment 2 structured as above, even at an inclination angle of the housing 21 of −10°, the problem of insufficient feed of developer to the developing sleeve 25*a* did not occur. However, at an inclination angle of the housing 21 of less than −10°, developer that accumulated near the second communication passage 29 in the feed chamber 21*s* ran the risk of flowing out through the opening 21*a* in the housing 21, i.e. the opening into which the developing roller 25 fits.

Note that in Embodiment 2 as well, factors such as the amount of developer transported by the mixing screw 22 and the feed screw 23 in the developing device 20 vary depending on the structure and location of the mixing screw 22 and the feed screw 23, the position of the screws, the composition of the toner and the carrier, etc. Therefore, the inclination angle of the developing device 20 at which the problem of insufficient toner fed to the developing sleeve 25*a* occurs also varies. Therefore, the mass of the closure plate 31, the spring constant of the extension spring 32, etc. should be appropriately changed in accordance with factors such as the configuration of the mixing screw 22 and the feed screw 23.

Modifications

The present invention is not limited to the above Embodiments. For example, the present invention is not limited to a developing device that uses two-component developer, but may also be adapted for use in a developing device that uses mono-component developer.

The present invention may also be adapted for use when only the developing device 20 is removable from the image forming unit A. Furthermore, the image forming apparatus according to the present invention is not limited to a tandem-type color digital printer, but may also be a printer that forms a monochrome image. Instead of a printer, the image forming apparatus may also be a copy machine, FAX, Multiple Function Peripheral (MFP), etc. that can form a color or monochrome image.

Summary of Embodiments

In the developing device of the present invention with the above structure, when the housing is inclined so that the second communication passage, which is located at the upstream edge of the first developer transport member, is lower than the first communication passage, the amount of developer that is directed through the second communication passage and into the mixing chamber is reduced. Therefore, there is no risk of developer accumulating in the mixing chamber near the second communication passage. Accordingly, transport efficiency of the developer by the first developer transport member does not decrease due to developer accumulating near the second communication passage, and the amount of developer in the feed chamber does not decrease, thus allowing developer to be fed stably to the developing roller in the feed chamber.

Preferably, the second communication passage has an outlet located at the mixing chamber and an inlet located at the feed chamber, the outlet being closer to the first communication passage than the inlet.

Preferably, the second communication passage has a first inner surface and a second inner surface that oppose each other, the first inner surface being a guiding surface located further downstream in the second direction than the second inner surface and being inclined so as to continuously approach the first communication passage from the inlet to the outlet, and an edge of the guiding surface located at the outlet is closer to the first communication passage than an edge of the second inner surface located at the inlet.

Preferably, the first inner surface and the second inner surface are parallel.

Preferably, an opening space reconfiguration unit configured to progressively reduce an open space in the second communication passage along a direction of inclination of the housing as the inclination angle of the housing increases, the housing being inclined so that the second communication passage is lower than the first communication passage.

Preferably, the opening space reconfiguration unit includes: a closure plate protruding into the second communication passage due to self weight when the housing is inclined so that the second communication passage is lower than the first communication passage and partially closing off the second communication passage; and a biasing unit to provide a bias force to the closure plate so that a length of the closure plate protruding into the second communication passage is approximately proportional to the inclination angle.

Preferably, carrier is stored along with toner in the housing.

In the context of a developing device in which a first developer transport member and a second developer transport member circulate developer, the first developer transport member transporting developer horizontally while mixing the developer, and the second developer transport member feeding developer, which has been transported by the first developer transport member, to a developing roller while transporting the developer in the opposite direction as the first developer transport member, the present invention is useful when the developing device is inclined with respect to the horizon.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A developing device for developing an electrostatic image on a photoreceptor using toner, the developing device comprising:

a mixing chamber including a first developer transport member that transports developer, which includes the toner, laterally in a first direction;

a feed chamber including a second developer transport member that transports the developer in a second direction opposite to the first direction;

a housing that encloses the mixing chamber and the feed chamber; and a developing roller provided in the feed chamber and configured to receive the developer transported by the second developer transport member and to develop the electrostatic image, wherein the housing includes:

a first communication passage configured to direct the developer transported by the first developer transport member to an upstream part of the second developer transport member with respect to the second direction; and a second communication passage configured to direct the developer transported by the second developer transport member to an upstream part of the first developer transport member with respect to the first direction, and the second communication passage is configured to progressively reduce the amount of developer that is directed through the second communication passage to the upstream part of the first developer transport member as an inclination angle of the housing increases corresponding to the second communication passage being lower than the first communication passage.

2. The developing device of claim 1, wherein the second communication passage has an outlet located at the mixing chamber and an inlet located at the feed chamber, the outlet being closer to the first communication passage than the inlet.

3. The developing device of claim 2, wherein the second communication passage has a first inner surface and a second inner surface that oppose each other, the first inner surface being a guiding surface located further downstream in the second direction than the second inner surface and being inclined so as to continuously approach the first communication passage from the inlet to the outlet, and an edge of the guiding surface located at the outlet is closer to the first communication passage than an edge of the second inner surface located at the inlet.

4. The developing device of claim 3, wherein the first inner surface and the second inner surface are parallel.

5. The developing device of claim 1, further comprising:

an opening space reconfiguration unit configured to progressively reduce an open space in the second communication passage along a direction of inclination of the housing as the inclination angle of the housing increases, the housing being inclined so that the second communication passage is lower than the first communication passage.

6. The developing device of claim 5, wherein the opening space reconfiguration unit includes:

a closure plate protruding into the second communication passage due to self weight when the housing is inclined so that the second communication passage is lower than the first communication passage and partially closing off the second communication passage; and a biasing unit to provide a bias force to the closure plate so that a length of the closure plate protruding into the second communication passage is approximately proportional to the inclination angle.

7. The developing device according to claim 1, wherein carrier is stored along with toner in the housing.

8. A process unit including a developing device for developing an electrostatic image on a photoreceptor using toner, the developing device comprising:

a mixing chamber including a first developer transport member that transports developer, which includes the toner, laterally in a first direction;

a feed chamber including a second developer transport member that transports the developer in a second direction opposite to the first direction;

a housing that encloses the mixing chamber and the feed chamber; and a developing roller provided in the feed chamber and configured to receive the developer transported by the second developer transport member and to develop the electrostatic image, wherein the housing includes:

a first communication passage configured to direct the developer transported by the first developer transport member to an upstream part of the second developer transport member with respect to the second direction; and a second communication passage configured to direct the developer transported by the second developer transport member to an upstream part of the first developer transport member with respect to the first direction, and the second communication passage is configured to progressively reduce the amount of developer that is directed through the second communication passage to the upstream part of the first developer transport member as an inclination angle of the housing increases corresponding to the second communication passage being lower than the first communication passage.

9. An image forming apparatus including a developing device for developing an electrostatic image on a photoreceptor using toner, the developing device comprising:

a mixing chamber including a first developer transport member that transports developer, which includes the toner, laterally in a first direction;

a feed chamber including a second developer transport member that transports the developer in a second direction opposite to the first direction;

a housing that encloses the mixing chamber and the feed chamber; and a developing roller provided in the feed chamber and configured to receive the developer transported by the second developer transport member and to develop the electrostatic image, wherein the housing includes:

a first communication passage configured to direct the developer transported by the first developer transport member to an upstream part of the second developer transport member with respect to the second direction; and a second communication passage configured to direct the developer transported by the second developer transport member to an upstream part of the first developer transport member with respect to the first direction, and the second communication passage is configured to progressively reduce the amount of developer that is directed through the second communication passage to the upstream part of the first developer transport member as an inclination angle of the housing increases corresponding to the second communication passage being lower than the first communication passage.

* * * * *